US006659829B2

(12) United States Patent
Weyhrauch

(10) Patent No.: US 6,659,829 B2
(45) Date of Patent: Dec. 9, 2003

(54) SINGLE-ENDED HALOGEN LAMP WITH IR COATING AND METHOD OF MAKING THE SAME

(75) Inventor: Ernest C. Weyhrauch, Cookeville, TN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 149 days.

(21) Appl. No.: 10/043,354

(22) Filed: Jan. 9, 2002

(65) Prior Publication Data

US 2003/0127979 A1 Jul. 10, 2003

(51) Int. Cl.[7] ..... H01K 3/20
(52) U.S. Cl. ..... 445/27; 445/32
(58) Field of Search ..... 445/27, 32

(56) References Cited

U.S. PATENT DOCUMENTS

| | | | | |
|---|---|---|---|---|
| 3,419,947 A | | 1/1969 | Gottschalk et al. | 29/25.16 |
| 3,475,641 A | | 10/1969 | Ayres | 313/271 |
| 3,780,333 A | * | 12/1973 | Flynn | 313/274 |
| 4,002,940 A | | 1/1977 | Ekkelboom et al. | 313/346 R |
| 4,254,356 A | | 3/1981 | Karikas | 313/217 |
| 4,288,713 A | | 9/1981 | Marlor | 313/117 |
| 4,305,632 A | | 12/1981 | de La Chapelle | 316/18 |
| 4,942,331 A | | 7/1990 | Bergman et al. | 313/271 |
| 5,473,226 A | * | 12/1995 | Beschle et al. | 313/580 |
| 5,660,462 A | * | 8/1997 | Bockley et al. | 362/256 |

* cited by examiner

*Primary Examiner*—Kenneth J. Ramsey
(74) *Attorney, Agent, or Firm*—Reising, Ethington, Barnes, Kisselle, P.C.

(57) ABSTRACT

A single-ended tungsten halogen lamp having a spherical or ellipsoidal envelope and an infrared reflective coating is manufactured using a mandrel alignment tool that radially centers an axially-oriented tungsten filament within the envelope. The manufacturing method includes forming the envelope in a glass tube. A filament assembly having an axially-oriented coiled tungsten filament is then placed into the interior of the envelope and the mandrel alignment tool is utilized to center the filament radially within the spherical or ellipsoidal envelope. The tool includes a tip that is inserted into the center of the tungsten coil to maintain the radial position of the filament during sealing of the glass tube around the filament assembly. After removing the tool, the glass tube is necked down and an inert halogen gas is placed within the envelope. The tube is then tipped off and the infrared reflective coating applied to form a completed bulb.

27 Claims, 2 Drawing Sheets

10
15
30
45
24
2
35
20
22
25
50
55
56
40
42
5
60

SINGLE-ENDED HALOGEN LAMP WITH IR COATING AND METHOD OF MAKING THE SAME

TECHNICAL FIELD

This invention relates to halogen lamps of the type that are used in vehicle headlights and to manufacturing methods for making such lamps.

BACKGROUND OF THE INVENTION

Halogen filament lamps generally comprise tubular vitreous envelopes enclosing a filament which is surrounded by an inert halogen gas. Such lamps are used in headlight systems for vehicles and have replaced traditional incandescent lamps which have lower light output with a higher energy consumption. Halogen incandescent lamps generally utilize a tungsten filament which is supported and connected to electrical lead wires which supply the filament with current and cause the filament to produce incandescent light. The presence of a halogen gas within the vitreous envelope allows for the recycling of the tungsten atoms which are released into the surrounding volume as the filament is heated to increase the life of a lamp.

A more recent development for increasing the efficiency of such halogen lamps has been to include a coating or filter which transmits visible light radiation but reflects infrared radiation back to the filament thereby decreasing the amount of electrical power used by the lamp without a significant decrease in the amount of visible light output. Such coatings or filters are known in the art and maybe found for example in U.S. Pat. Nos. 4,663,557 and 4,701,663.

When such infrared reflective coatings are utilized, it is necessary that the filament be centered or aligned along the optical axis of the vitreous tube for the coating to effectively reflect the infrared radiation back onto the filament.

U.S. Pat. No. 4,942,331 to Bergman et al. discloses a double ended HIR (halogen infrared) filament lamp including a quartz glass tubular envelope having an infrared reflective coating and enclosing an axially-oriented tungsten filament that is connected to a molybdenum foil inlead. The inlead is connected to the filament utilizing plasma or laser welding to join the ends of the filaments and inleads. The inleads include spuds which generally comprise a refractory metal wire in the shape of a circular ring that is connected to the filament and allows for positioning of the filament within a central portion of the quartz tube. The lamp manufacturing technique of the U.S. Pat. No. 4,942,331 patent utilizes plasma or laser welding operations to connect the spud with the filament which is enclosed in a high melt temperature quartz glass. This combination of quartz glass tubing, spuds, and molybdenum foil inleads can be difficult and expensive to manufacture.

In non-HIR automotive headlamp applications where relative positioning of multiple filaments is needed, it is known to form a single-ended halogen lamp using a positioning device that is inserted into a first end of a glass tube to hold high and low beam filaments in a set position during sealing of a second end of the tube. See, for example, U.S. Pat. No. 4,305,632 to de La Chapelle. For transverse mounted filaments, the positioning device includes a pair of transverse slots in its lower end. The slots are spaced apart by a separator having a width suitable for maintaining the desired spacing of the filaments. For axially-oriented filaments, the patent states that the positioning device would have longitudinal grooves or holes to contain the filaments during the press sealing operation. The positioning devices disclosed in this patent are used to set the position of one filament relative to another within a generally cylindrical glass envelope that does not have an infrared reflective coating and that does not have a spherical or ellipsoidal shape suitable for use with such coatings.

There is therefore a need in the art for producing a cost effective halogen lamp having an enlarged envelope that includes an infrared coating and a filament that is precisely centered within the envelope. It is therefore a general object of the present invention to provide a method of producing a single ended tungsten halogen lamp having an enlarged envelope with an infrared reflective coating and a filament radially centered within the envelope.

SUMMARY OF THE INVENTION

In accordance with one aspect of the present invention, there is provided a method of making a halogen lamp having an axially-oriented filament. The method includes the steps of:

(a) providing a glass tube having first and second ends and an enlarged section located between the first and second ends;

(b) providing a filament assembly that includes a filament supported on one or more lead wires;

(c) inserting the filament assembly into the first end of the glass tube such that the filament is oriented axially within the enlarged section of the glass tube;

(d) centering the filament within the enlarged section of the glass bulb using a mandrel alignment tool that is inserted into the second end of the glass tube;

(e) sealing the first end of the glass tube around the filament assembly;

(f) removing the mandrel alignment tool from the glass tube;

(g) filling the glass tube with a halogen gas; and (h) sealing the glass tube at a location between the enlarged section and the second end.

Preferably, the mandrel alignment tool has a base with tip that extends down from the base and into the center of the filament which is preferably in the conventional form of a coil. At least a section of the base has an outer diameter that is the same as the inner diameter of the glass tube so that when that section of the base is inserted into the glass tube, the tip is centered radially and the mandrel alignment tool is restricted from any radial movement. The enlarged section of the glass tube preferably has a spherical or ellipsoidal shape and is coated on its exterior surface with an infrared reflective material.

In accordance with another aspect of the present invention, there is provided a single-ended halogen lamp that can be manufactured according to the inventive method disclosed herein. The lamp includes a glass envelope having first and second sealed ends and a spherical or ellipsoidal region located between the first and second ends. A pair of leads extend through the first sealed end from an exterior, exposed location to an interior located within the glass envelope. A filament is electrically connected to the leads, with the filament being oriented along an axis extending between the first and second ends and being radially centered within the glass envelope. A halogen gas fill is contained within the glass envelope and an infrared reflective coating is disposed on a surface of the spherical or ellipsoidal region to reflect infrared light back onto the filament for increased efficiency.

Preferably, the filament is a coiled tungsten filament axially oriented within the glass envelope and the region is ellipsoidal in shape with its two foci each located at the filament proximate an opposite end of the filament.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENT

Figures 1A, 1B, 1C, 1D, 1E, 1F, 1G, 1H:
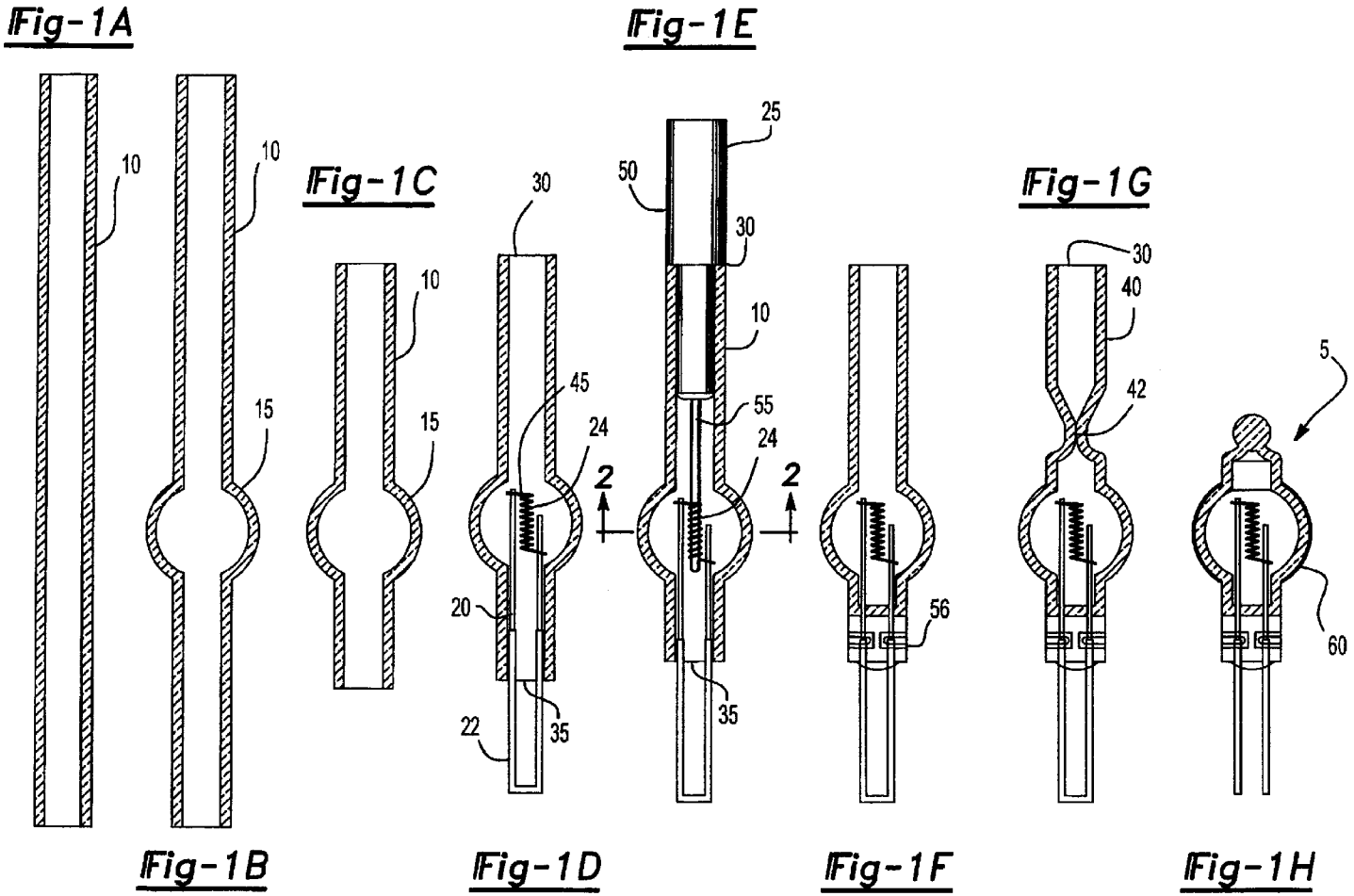
FIGS. 1A through 1H illustrates various steps involved in a preferred embodiment of the manufacturing method of the present invention.

With reference to FIGS. 1A through 1C, there is shown a glass tube 10 that is first cut to an appropriate (initial) length and then has an enlarged section 15 formed in the glass tube 10. The glass tube 10 is then cut to a final working length after the section 15 has been formed. The glass tube 10 can be any of a variety of different glass compositions, including quartz glass or an aluminosilicate glass that has a lower melting temperature than quartz glass and therefore simplifies the manufacturing process. The aluminosilicate glass is also less expensive.

The aluminosilicate glass can be Corning™ 1724 glass tubing having a 10.5 mm outside diameter with a thickness of 0.9 mm. The enlarged section 15 can be a spherical or ellipsoidal section formed while the tubing is installed on a glass lathe and rotated while heating. Utilizing a two piece mold and pressurizing the interior, a spherical or ellipsoidal section preferably having a 16 mm diameter is blown into the tube 10. For an ellipsoidal shape, the foci of the ellipsoid are preferably spaced by a distance equal to the length of the filament coil 45 shown in subsequent figures. After the section 15 is formed, the glass tube 10 is then cut to a smaller working size for subsequent processing.

With reference to FIG. 1D, a filament assembly 20 that includes a lead portion 22 and a filament portion 24 is inserted into a first end 35 of the glass tube 10. The filament leads 22 are preferably simple molybdenum wire leads that are commonly used in the lamp manufacturing industry. The filament 24 is preferably made of tungsten in the form of a coil, and is welded or otherwise attached to the leads 22 using known techniques. As shown, the coil portion 45 of the filament 24 is attached to the leads 22 such that it has an axial orientation; that is, it is oriented along a central axis extending between the first and second ends of the glass tube 10. The filament 24 is axially centered within the envelope and, for an ellipsoidal section 15, is centered axially so that the two foci of the ellipsoid are located at the filament proximate opposite ends of the filament.

Figure 2:
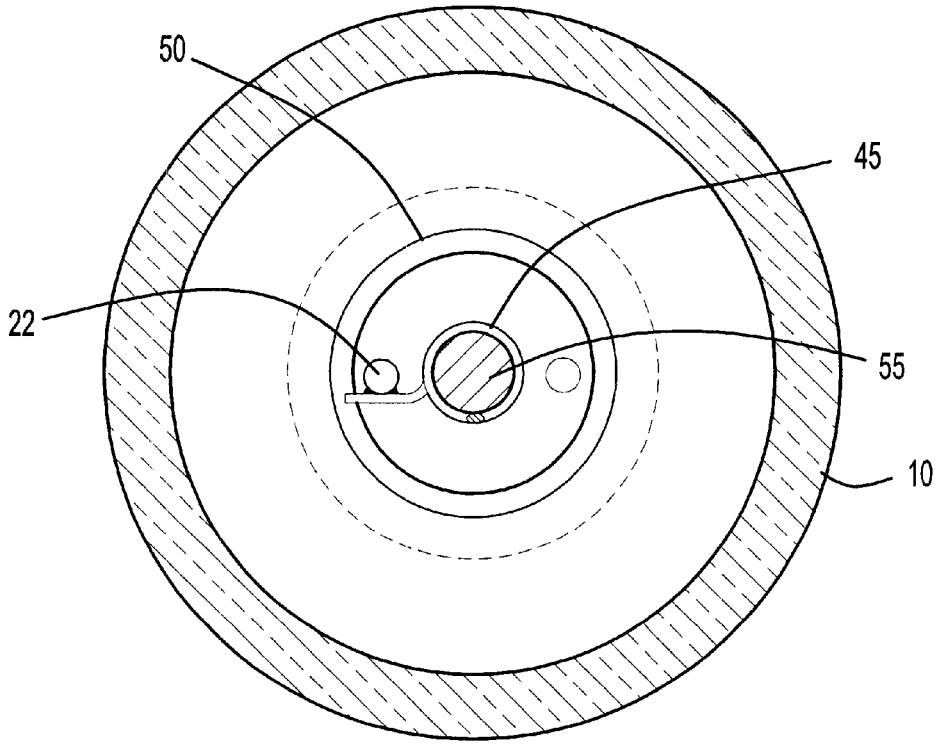
FIG. 2 is a enlarged, cross-sectional view taken along the 2—2 line of FIG. 1E and depicting the interaction of the mandrel alignment tool with the coil portion of the filament.

After the filament assembly 20 has been inserted into and axially centered within the enlarged section 15 of the glass tube 10, a mandrel alignment tool 25 is inserted into the glass tube 10 from a second end 30 such that the mandrel alignment tool 25 engages the filament to center it radially within the spherical or ellipsoidal section 15. This is shown in FIG. 1E and in the cross-section of FIG. 2. The mandrel alignment tool 25 includes a base portion 50 and a filament engaging portion, or tip, 55. A section of the base 50 has a reduced outer diameter that is equal to the inner diameter of the glass tube 10 so that, once this section of the base enters the glass tube, the mandrel alignment tool including, in particular, the tip 55, can freely move axially within the tube, but is substantially restricted from radial movement. The length of the tip can be selected so that the reduced diameter portion of the base 50 enters the glass tube before the tip 55 engages the coil 45. In this way, the tip is radially centered when it engages the filament and is maintained centered as it slides through the center of the coil to the final position shown in FIG. 1E. The reduced portion of the base 50 defines a shoulder (shown engaging the second end 30) and this can be used to limit the downward travel of the tool. It will, however, be appreciated that the entire base could have a fixed diameter with other means being used to limit the extent of downward travel. The tip 55 of the mandrel alignment tool is tapered to facilitate entry into the coil portion 45 of the filament 24, and the outer diameter of the tip is selected relative to the inner diameter of the coil such that it engages the filament 24 in a slip fit that does not place any significant stress on the filament.

With reference to both FIGS. 1E and 1F, after the mandrel alignment tool 25 has been inserted into the glass tube 10 to maintain the centered location of the filament 24, the glass tube is placed in a single head press machine mount holding fixture (not shown) wherein the first end 35 of the glass tube 10 is heated by opposing gas burners. While the glass is heated, nitrogen is injected into the bulb interior through the fixture to protect the mount assembly from oxidation. When the glass reaches a sufficient temperature, the machine jaws of the press machine (not shown) closes to form the press area 56 of the lamp 5. This seals the first end 35, locking the filament assembly 20 (and, thus, filament 24) in place relative to the envelope. After the pressing operation, the mandrel alignment tool 25 is removed from the glass tube 10.

With reference to FIG. 1G, the second end 30 of the glass tube 10 is then necked down to form an exhaust tube 40. This can be done by mounting the glass tube 10 on a glass lathe (not shown) with heat being applied while the bulb assembly is rotated and nitrogen is injected into the interior of the bulb to protect the mount from oxidation. Again, when the glass is sufficiently hot, the upper portion of the second end 30 is pulled away from the bottom portion, stretching the glass and forming the exhaust tube 40 and the corresponding narrowed portion 42. After the exhaust tube 40 has been formed in the glass tube 10, the glass tube is then heated, flashed, flushed, and filled with an appropriate halogen gas. The glass tube is then immersed in liquid nitrogen (not shown) and tipped off to form the completed lamp 5, as shown in FIG. 1H. These final steps shown in FIGS. 1G and 1H can be done using conventional techniques.

After the bulb has been tipped off, the lamp 5 is coated with an infrared reflective coating 60 using a multi-layer thin film process. Such processes are commonly known in the art.

Figure 3:
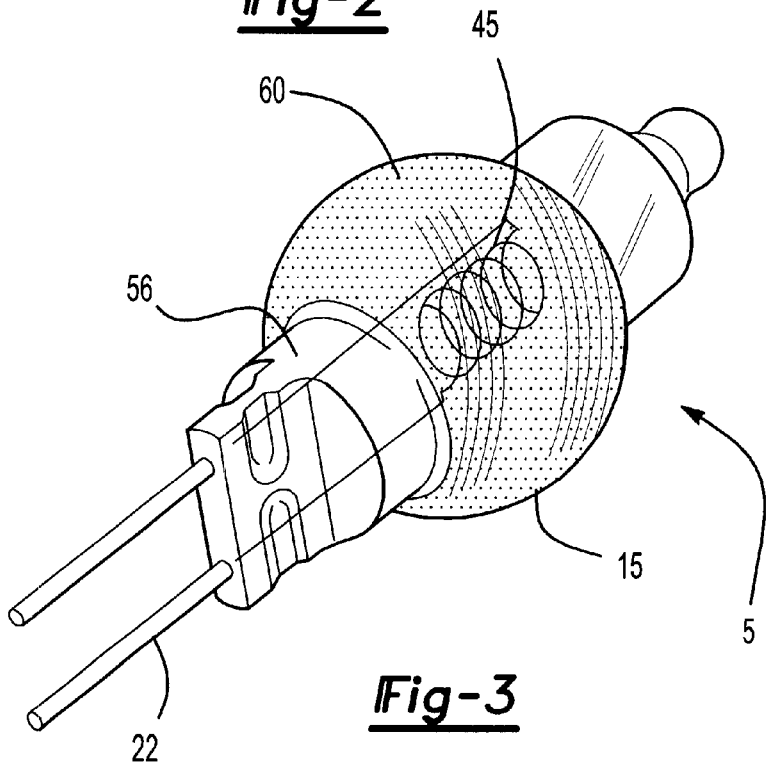
FIG. 3 is a perspective view of a completed halogen lamp manufactured according to the steps of FIGS. 1A through 1H.

The resulting single-ended halogen lamp 5 is shown in FIG. 3. The lamp includes a glass envelope having first and second sealed ends and a spherical or ellipsoidal region 15 located between the first and second ends. A pair of leads 22 extend through the first sealed end 56 from an exterior, exposed location to an interior located within the glass envelope. A filament 45 is electrically connected to the leads, with the filament being oriented along an axis extending between the first and second ends and being radially centered within the glass envelope. A halogen gas fill is contained within the glass envelope and an infrared reflective coating 60 is disposed on a surface of the envelope region 15 to reflect infrared light back onto the filament for increased efficiency.

It will thus be apparent that there has been provided in accordance with the present invention a single-ended halogen lamp and manufacturing method therefor which achieves the aims and advantages specified herein. It will of course be understood that the foregoing description is of preferred exemplary embodiments of the invention and that the invention is not limited to the specific embodiments shown. Various changes and modifications will become apparent to those skilled in the art. For example, although the leads 22 of the illustrated embodiment are electrically connected directly to the filament, it will be understood that they could be connected indirectly to the filament to supply current through one or more intermediate elements. Also, while the leads 22 mechanically support the filament, one or more other mechanical supports could be used in addition to or in lieu of these leads 22. All such variations and modifications are intended to come within the scope of the appended claims.

I claim:

1. A method of making a single ended halogen lamp, comprising the steps of:

(a) providing a glass tube cut to an appropriate length;

(b) forming a spherical or ellipsoidal section in the glass tube;

(c) cutting the glass tube to a final working length after forming the spherical or ellipsoidal section;

(d) mounting a filament within the glass tube utilizing a mandrel alignment tool that is inserted from a first end of the glass tube and that engages the filament such that the filament is centered radially within the spherical or ellipsoidal section;

(e) sealing a second end of the glass tube while the mandrel alignment tool is inserted within the glass tube;

(f) removing the mandrel alignment tool from the glass tube;

(g) necking the glass tube from the first end to form an exhaust tube; and (h) filling the glass tube via the exhaust tube with an inert halogen gas and tipping off the exhaust tube.

2. The method of claim 1, wherein the mandrel alignment tool engages the filament in a coil portion of the filament.

3. The method of claim 1, wherein the mandrel alignment tool comprises a base and a filament engaging portion and wherein the filament engaging portion is tapered to facilitate engagement with the filament.

4. The method of claim 1, wherein the mandrel alignment tool engages the filament in a slip fit.

5. The method of claim 1, further including applying an infrared reflective coating to the glass tube.

6. The method of claim 5, wherein said applying step further comprises applying the infrared reflective coating to an exterior surface of the spherical or ellipsoidal section using a multi-layer thin film process.

7. The method of claim 1, wherein step (e) further comprises supporting the filament on a pair of lead wires and sealing the second end about the lead wires while the filament is radially centered by the mandrel alignment tool to thereby fix the position of the filament within the spherical or ellipsoidal section.

8. A method of making a halogen lamp having an axially-oriented filament, comprising the steps of:

(a) forming a spherical or ellipsoidal section in a middle region of a glass tube;

(b) mounting a filament within the glass tube by orienting the filament axially within the spherical or ellipsoidal section and utilizing a mandrel alignment tool that includes a base portion and a tapered filament engaging portion, and wherein the mandrel alignment tool is inserted from a first end of the glass tube with the filament engaging portion entering within a coil portion of the filament such that the filament engaging portion radially centers the filament within the spherical or ellipsoidal portion of the glass tube;

(c) sealing a second end of the glass tube while the mandrel alignment tool maintains the filament radially centered within the spherical or ellipsoidal section;

(d) removing the mandrel alignment tool from the glass tube;

(e) filling the glass tube with a halogen gas;

(f) sealing the glass tube at a location between the first end and the spherical or ellipsoidal section; and (g) coating a surface of the enlarged section with an infrared reflective material.

9. The method of claim 8, wherein the mandrel alignment tool engages the filament in a slip fit.

10. The method of claim 8, further including applying an infrared reflective coating to the glass tube.

11. The method of claim 10, wherein said applying step further comprises applying the infrared reflective coating to an exterior surface of the spherical or ellipsoidal section using a multi-layer thin film process.

12. The method of claim 8, wherein step (c) further comprises supporting the filament on a pair of lead wires and sealing the second end about the lead wires while the filament is radially centered by the mandrel alignment tool to thereby fix the position of the filament within the spherical or ellipsoidal section.

13. The method of claim 8, wherein step (a) further comprises providing a glass tube cut to an appropriate length, forming the spherical or ellipsoidal section in the glass tube, and cutting the glass tube to a final working length.

14. The method of claim 8, wherein step (e) further comprises forming an exhaust tube by necking the glass tube near the first end, and filling the glass tube via the exhaust tube with a halogen gas.

15. The method of claim 14, wherein step (f) further comprises tipping off the exhaust tube.

16. A method of making a halogen lamp having an axially-oriented filament, comprising the steps of:

(a) providing a glass tube having first and second ends and an enlarged section located between the first and second ends;

(b) providing a filament assembly that includes a filament supported on one or more lead wires;

(c) inserting the filament assembly into the first end of the glass tube such that the filament is oriented axially within the enlarged section of the glass tube;

(d) centering the filament within the enlarged section of the glass bulb using a mandrel alignment tool that is inserted into the second end of the glass tube;

(e) sealing the first end of the glass tube around the filament assembly;

(f) removing the mandrel alignment tool from the glass tube;

(g) filling the glass tube with a halogen gas; and (h) sealing the glass tube at a location between the enlarged section and the second end.

17. The method of claim 16, wherein step (d) further comprises inserting the mandrel alignment tool within the second end of the glass tube, centering the mandrel alignment tool within the glass tube, and centering the filament by engagement of the mandrel alignment tool with the filament.

18. The method of claim 17, wherein the step of centering the mandrel alignment tool further comprises providing the mandrel alignment tool with a base portion, at least a section of which has an outer diameter equal to an inner diameter of the glass tube so that the mandrel alignment tool cannot move radially within the glass tube when the section of the base portion is inserted within the glass tube.

19. The method of claim 18, wherein the step of inserting the mandrel alignment tool further comprises inserting the mandrel alignment tool into the glass tube until a shoulder on the base portion engages the second end of the glass tube.

20. The method of claim 16, wherein step (d) further comprises inserting the mandrel alignment tool within the second end of the glass tube until a tip of the mandrel alignment tool enters into a coil portion of the filament.

21. The method of claim 20, wherein step (e) further comprises sealing the first end about the one or more lead wires while the tip is inserted within the coil portion of the filament.

22. The method of claim 16, further comprising the step of coating a surface of the enlarged section with an infrared reflective material.

23. The method of claim 22, wherein the coating step further comprises applying the infrared reflective material to an exterior surface of the enlarged section using a multilayer thin film process.

24. The method of claim 16, wherein step (c) further comprises inserting the filament assembly into the first end of the glass tube and axially centering the filament within the enlarged section of the glass tube.

25. The method of claim 16, wherein step (a) further comprises providing a glass tube cut to an appropriate length, forming the enlarged section as a spherical or ellipsoidal section in the glass tube, and cutting the glass tube to a final working length.

26. The method of claim 16, wherein step (g) further comprises forming an exhaust tube by necking the glass tube near the second end, and filling the glass tube via the exhaust tube with a halogen gas.

27. The method of claim 16, wherein the glass tube comprises aluminosilicate glass.

* * * * *